US010442563B2

(12) United States Patent
Baker

(10) Patent No.: US 10,442,563 B2
(45) Date of Patent: Oct. 15, 2019

(54) FUEL ADDITIVE BOTTLE FOR USE WITH CAPLESS FUEL SYSTEM

(71) Applicant: William Edward Baker, Marietta, GA (US)

(72) Inventor: William Edward Baker, Marietta, GA (US)

( * ) Notice: Subject to any disclaimer, the term of this patent is extended or adjusted under 35 U.S.C. 154(b) by 109 days.

(21) Appl. No.: 15/867,931

(22) Filed: Jan. 11, 2018

(65) Prior Publication Data

US 2018/0134437 A1 May 17, 2018

Related U.S. Application Data

(63) Continuation of application No. 13/937,568, filed on Jul. 9, 2013, now Pat. No. 9,889,961.

(51) Int. Cl.
*B65D 1/02* (2006.01)
*B67D 3/00* (2006.01)

(52) U.S. Cl.
CPC ..... *B65D 1/0246* (2013.01); *B67D 3/0051* (2013.01)

(58) Field of Classification Search
CPC ..... B65D 1/0246; B67D 3/0051
See application file for complete search history.

(56) References Cited

U.S. PATENT DOCUMENTS 963,517 A 7/1910 Coll
1,492,978 A 7/1923 Hammer
1,487,824 A * 3/1924 Vincent ..... B67C 11/02 141/297
1,522,167 A * 1/1925 Young ..... B67C 11/02 141/310
2,596,034 A 9/1949 Lambert, Jr. ..... 23/254
4,948,001 A 8/1990 Magly ..... 215/31
5,634,504 A * 6/1997 Chandler ..... B65D 51/1611 141/114
6,123,212 A * 9/2000 Russell ..... B65D 41/0471 215/307
6,142,193 A * 11/2000 Sanders ..... B65B 39/04 141/300
D576,884 S 9/2008 Feen
D642,926 S 8/2011 Jamieson
8,668,120 B2 3/2014 Hall
(Continued)

FOREIGN PATENT DOCUMENTS

GB 2275047 A 8/1994
GB 2399559 B 7/2006
(Continued)

*Primary Examiner* — Timothy L Maust
*Assistant Examiner* — James R Hakomaki
(74) *Attorney, Agent, or Firm* — MacCord Mason PLLC

(57) ABSTRACT

A fuel additive bottle has a neck and thread pattern that allows insertion into a capless fuel system so the bottle's contents can be poured by gravity into a fuel tank. The neck of the bottle is elongated and has a diameter of approximately 0.854", and the novel thread pattern includes thread interruptions that form at least one threadless path. In use, the spring loaded tabs of a capless fuel system are depressed by the threadless path portion of bottle, thereby triggering the self-sealing mechanism to open, so the fluid receiving aperture is exposed. The use of the threadless paths facilitates the safe and easy entry and removal of the bottle from the capless fuel system.

10 Claims, 17 Drawing Sheets

(56) References Cited

U.S. PATENT DOCUMENTS

| | | | | |
|---|---|---|---|---|
| 2012/0285579 | A1 | 11/2012 | Dudley | |
| 2013/0319572 | A1 | 12/2013 | Zweifel | 141/1 |

FOREIGN PATENT DOCUMENTS

| | | | |
|---|---|---|---|
| JP | 11348953 | | 12/1999 |
| NL | 52357 | C | 4/1942 |
| WO | 2009073137 | A1 | 6/2009 |

* cited by examiner

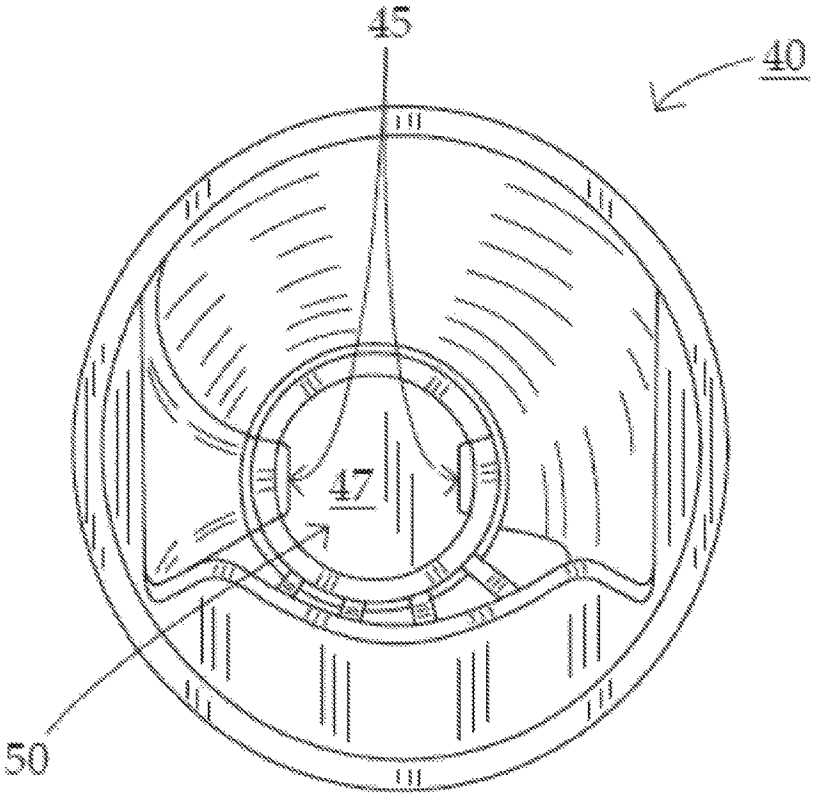
FIG. 1 – PRIOR ART

FUEL ADDITIVE BOTTLE FOR USE WITH CAPLESS FUEL SYSTEM

CROSS-REFERENCE TO RELATED APPLICATIONS

This application is a Continuation of, and claims the benefit of U.S. patent application Ser. No. 13/937,568, filed Jul. 9, 2013, entitled "FUEL ADDITIVE BOTTLE FOR USE WITH CAPLESS FUEL SYSTEM".

BACKGROUND OF THE INVENTION

Field of the Invention

The present invention relates to bottles used in the industrial chemicals industry, and more specifically, to a transportation, storage and pouring vessel that is sized and shaped to introduce fluid matter into capless fuel systems.

Description of the Prior Art

Many vehicle operators utilize fuel additives in order to modify or improve certain characteristics such as gasoline's octane rating, or act as a corrosion inhibitor or lubricant. An example of a common and commercially available fuel additive is STP® brand "Gas Treatment". Fuel additives typically include components such as metal deactivators, corrosion inhibitors, oxygenates and antioxidants. Typically a user purchases a fuel additive in a container having an elongated neck that terminates in the container opening. This design allows many fuel additive users to simply remove the container cap, direct the opening of the container into the gas tank opening, and pour in the contents. The specific size and shape of the container varies by manufacturer and product.

The addition of fuel additives into capless gas systems, however, is more complicated. In general, a capless gas system does not have a cap, but rather a self-sealing mechanism at the point of entry of fuel for the fuel tank. This self-sealing mechanism is typically a spring-loaded interior lid that allows entry of a standard fuel-pump nozzle, but remains closed when a nonstandard fuel-pump nozzle attempts to gain entry. The opening action is activated by the depression of two tabs along the perimeter of the gas spout entry point. Capless gas systems are gaining in popularity with automobile manufacturers because they are considered an improvement over standard systems as they prevent fueling with the wrong type of fuel, prevent fuel theft, and because they greatly reduce environmental hazards such as fuel spillage and evaporation that arises from improperly tightened or otherwise defective gas caps. An example of a capless fuel system is Ford Motor Company's EASY FUEL® system.

Because capless gas systems are specifically designed to prevent the introduction of substances into the gas tank using a nonstandard nozzle or spout, it is not possible to introduce fuel additives to capless gas systems using the current standard fuel additive containers. As a result, motorists having capless gas systems either can't use fuel additives, or they experience great difficulty if they attempt to use a standard fuel additive container to introduce the fuel additive into their capless gas tank. Spillage of these liquids is messy, can damage the car's paint, and can be hazardous to both people and the environment.

In order to overcome the difficulty of introducing fuel additives into capless gas tanks, one may employ a funnel-like device that is sized and shaped like a gas nozzle, thereby allowing entry of the device and dispensing the additive into the fuel tank. These funnel-like devices, however, are cumbersome, may or may not fit a given bottle, often require post-use cleanup and storage, and may lead to spillage of hazardous chemicals. Moreover, car operators are accustomed to being able to simply pour their additives from the storage bottle, and are inconvenienced by, or unaware of, the need for a separate funnel.

In short, it would be ideal if fuel additives came in a bottle that was capable of dispensing liquids into a capless gas tank. However, this has proved to be difficult. In order to have a bottle that is useful for transporting and storing fuel additives, the bottle must be inexpensive, disposable and capable of being closed, preferably with a standard cap, like conventional fuel additive bottles. In other words, it must be mass produced using materials and production methods known in the industry.

In order for a spout to gain entry to a capless gas tank, tabs around the perimeter of the capless system's entry point must be uniformly depressed a specific distance. It is this specificity that permits an unleaded gas nozzle, for example, to dispense gas into a capless gas tank system of a car that requires unleaded gas, but prevents entry of a diesel gas spout, or a siphoning hose.

Until now, current standard fuel additive bottles having continuous threads cause difficulty in neck entry and extraction from capless fuel systems. This is because the conventional thread pattern, which wraps around the entire perimeter of the bottle spout, can't properly address the function of a capless system's entry/exit point. More specifically, upon extraction from the capless fuel system, depression tabs need to abut and slide along a planar surface in order to "exit" the fuel door, and permit removal of the spout. Conventional threads provide a bumpy surface for abutting tabs, thereby preventing proper depression of tabs. Moreover, depressed tabs get stuck on bumpy threads, so the spring loaded door mechanism, which allows entry to the tank, can't be pushed open with the end of the spout.

In order to resolve the various problems associated with introducing fuel additives into capless gas tanks, there is a need for an improved bottle that eliminates the need for a separate funnel. It is desirable that this improved bottle can be produced using conventional methods and equipment, and that it can be used with standard, commercially available bottle caps having standard thread patterns. It is desirable that the aesthetics of this improved bottle can vary in order to maintain brand identity for a variety of different products and companies. It is desirable that the improved bottle is disposable, easy to use, and complies with environmental regulations related to storing, transporting and dispensing chemicals. It is also desirable that this bottle also works fine with conventional fuel systems that utilize a removable gas cap.

SUMMARY OF THE INVENTION

The present invention pertains to a fuel additive bottle for a capless fuel system. The bottle can have the general look and feel of a conventional fuel additive, including shape of the reservoir and transition, coloration and labeling, and including a conventional bottle cap. However, the neck of the bottle is preferably cylindrical and of a minimum length, and have an outer diameter within a specific range. In addition, the thread pattern should have between one and four, and preferably two, interruptions, thereby creating threadless paths leading substantially perpendicularly inward from the proximal end of the lip of the bottle. Upon placing the bottle into the associated capless fuel system, and alignment of the threadless path with the tabs, the bottle can be inserted into the system for spill-free pouring of the additive into the gas tank. Access to the aperture of the capless system requires alignment of the tabs with the threadless path. Proper alignment of the threadless path and tabs merely requires turning the bottle until the bottle eases inward. Extraction of the bottle becomes feasible because of the threadless paths. Without the threadless paths, extraction would be very difficult and could break off a portion of the bottle thereby contaminating the fuel and fuel tank.

BRIEF DESCRIPTION OF THE DRAWINGS

FIG. 1 is a front view of a conventional capless fuel system;

DETAILED DESCRIPTION OF THE INVENTION

Figure 3:
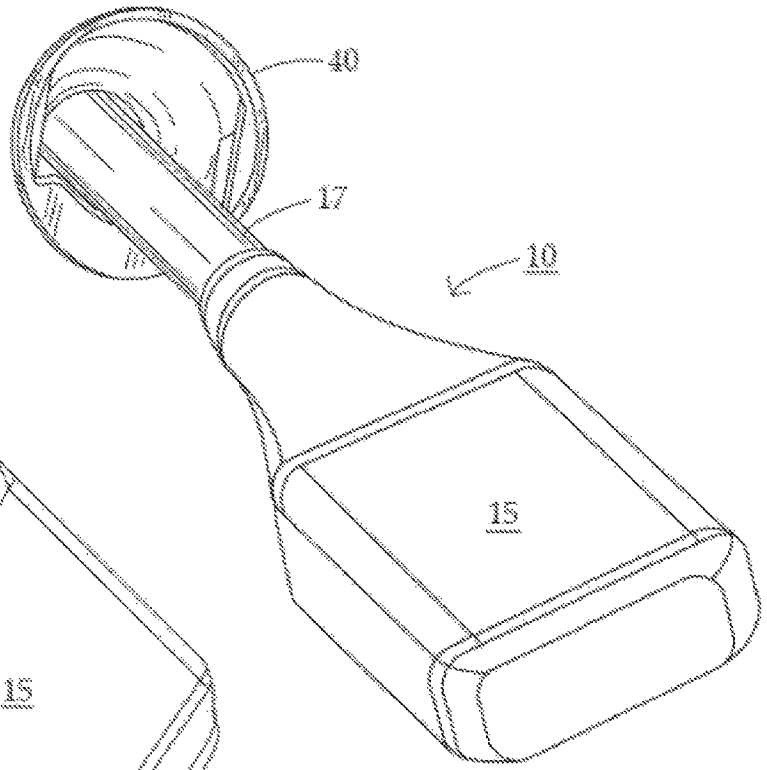
FIG. 3 is a perspective view of a fuel additive bottle of the present invention inserted into a capless fuel system.
Figure 2:
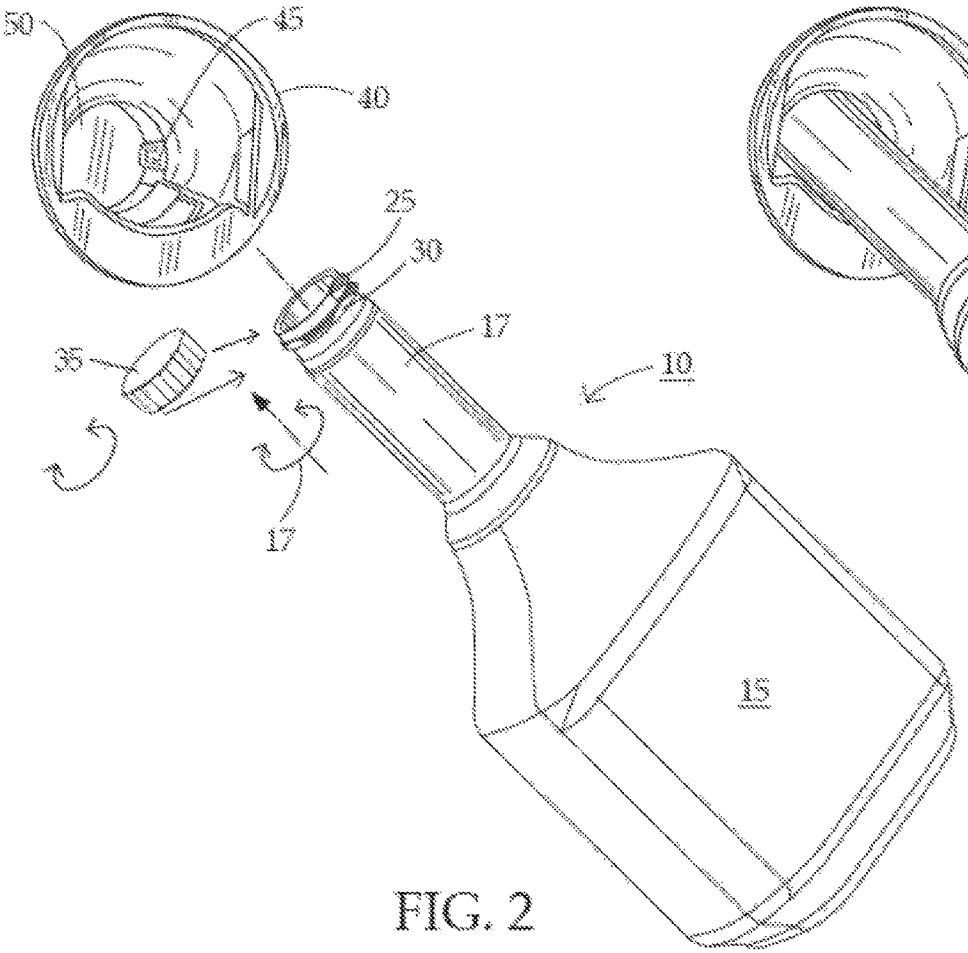
FIG. 2 is a perspective view of a fuel additive bottle of the present invention positioned for insertion into a capless fuel system, with a bottle cap positioned to be rotatably engaged with a threaded lip.
Figure 5:
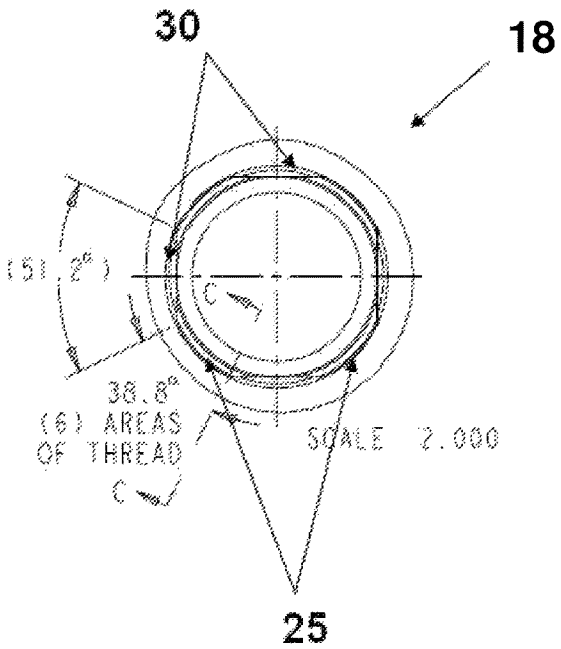
FIG. 5 is another top view of the same embodiment of the device from FIG. 4, depicting the threads and thread interruptions.

The following detailed description is of the best currently contemplated modes of carrying out exemplary embodiments of the invention. The description is made merely for the purpose of illustrating the general principles of the invention, and should not be construed as limiting the invention.

The following structure numbers shall apply to the following structures among the various FIGS.:

10—Bottle;
15—Reservoir;
17—Neck;
18—Lip;
20—Transition;
25—Threads;
30—Thread interruption;
32—Threadless path;
35—Bottle cap;
40—Capless fuel system;
45—Tabs;
47—Self sealing mechanism; and
50—Fluid receiving aperture.

As used herein, "pourable matter", "fluids" and "liquids" are used interchangeably unless otherwise noted, and collectively refer to substances which can be poured. Also, "fuel additives" generally refer to substances that are added to a fuel system.

Referring to FIG. 1, representative capless fuel system 40 is an alternative to the standard gas tank filling assembly having a gas cap which covers the gas receiving aperture when the tank isn't being filled. In a standard gas tank one removes a gas cap, inserts a nozzle, and adds fuel or an additive that flows down a conduit to the gas tank. Specific capless fuel systems may vary, but generally include a fluid receiving aperture 50 through which fuel and additives are added to the vehicle's gas tank. Instead of a gas cap, however, self-sealing mechanism 47 prevents nozzle insertion unless tabs 45 are properly depressed. When tabs 45 are properly depressed, self-sealing mechanism 47 moves, thereby allowing insertion of a nozzle.

Embodiments of the present invention provide bottles 10, 110, 210, 310, 410 and 510 which each include a properly sized and shaped rigid neck 17 that fits through fluid receiving aperture 50 of capless fuel system 40, when self-sealing mechanism 47 is not blocking entry. Neck 17 may be cylindrical or oval in cross-section, preferably substantially smooth, has an outside diameter of 0.846 to 0.862, preferably 0.854 inches, and is approximately 1.9 to 2.5 inches long, although longer necks would also work.

Figure 4:
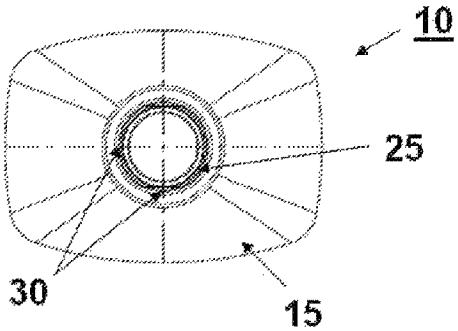
FIG. 4 is a top view of an embodiment of the device.
Figure 6:
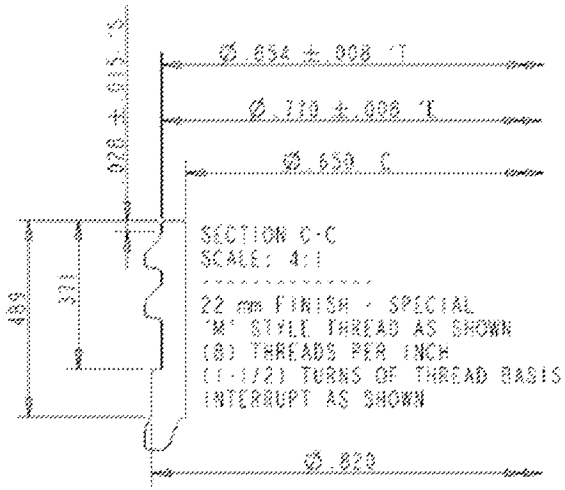
FIG. 6 is a plan view of desired specifications for threads and thread interruptions of the same embodiment of the device from FIG. 4.
Figure 8:
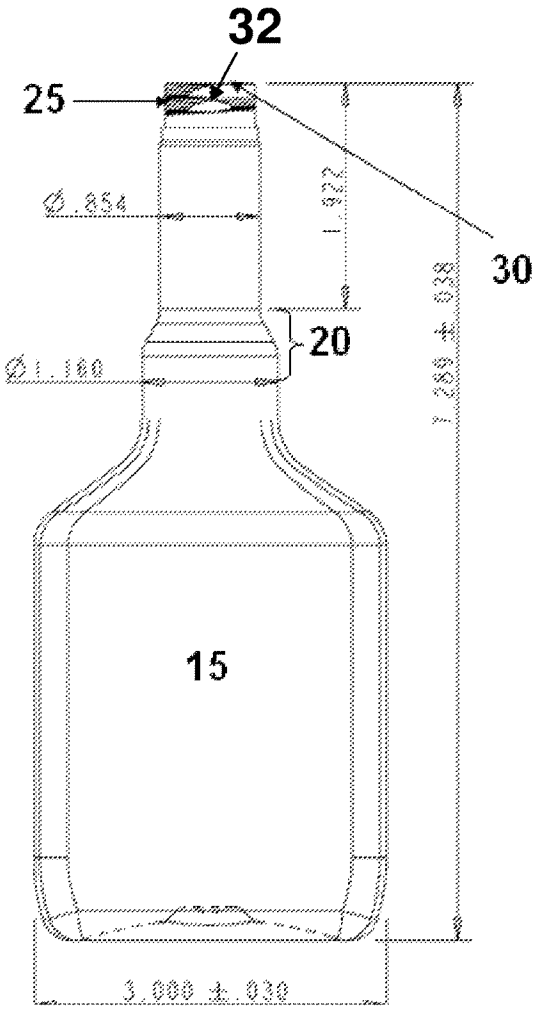
FIG. 8 is a front view of the same embodiment of the device from FIG. 4.
Figure 7:
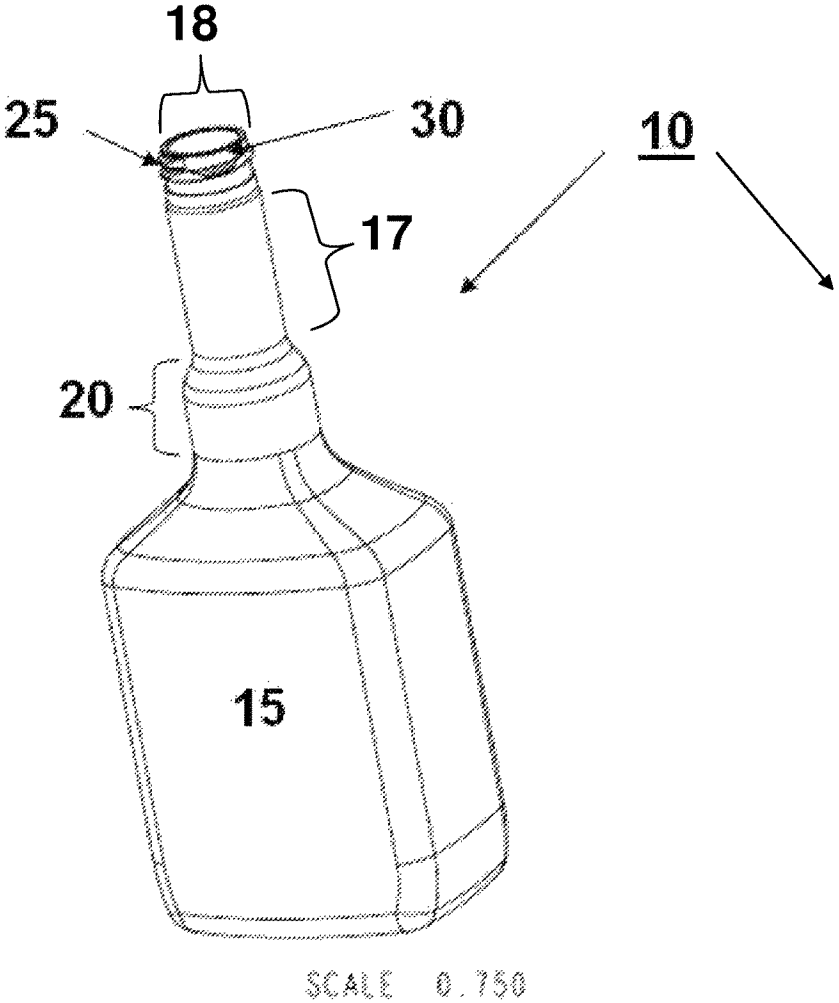
FIG. 7 is a perspective view of the same embodiment of the device from FIG. 4.
Figure 10:
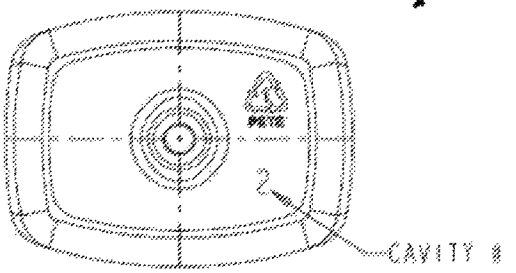
FIG. 10 is a bottom view of the same embodiment of the device from FIG. 4.
Figure 9:
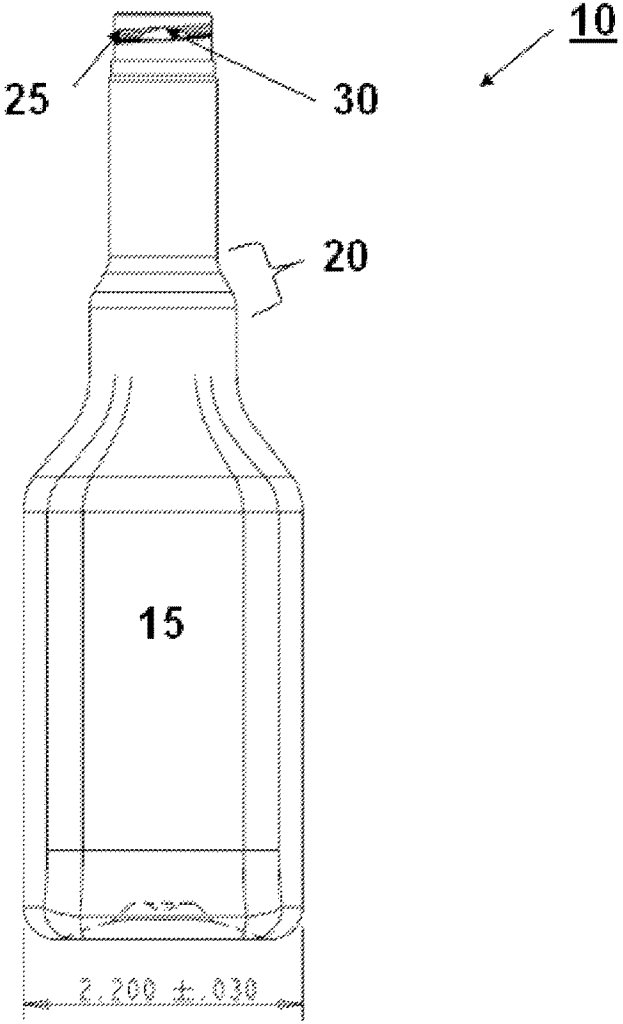
FIG. 9 is a side view of the same embodiment of the device from FIG. 4.
Figure 12:
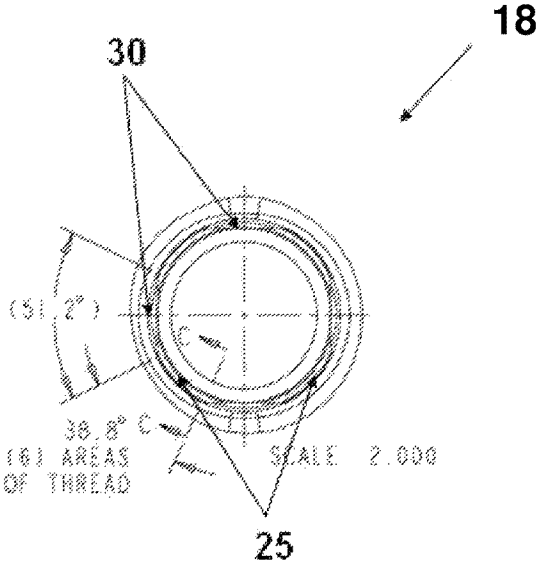
FIG. 12 is another top view of the same embodiment of the device from FIG. 11, depicting the threads and thread interruptions.
Figure 11:
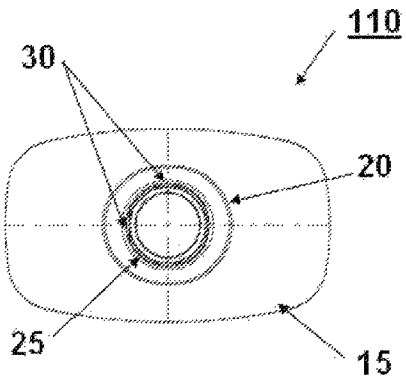
FIG. 11 is a top view of another embodiment of the device.
Figure 13:
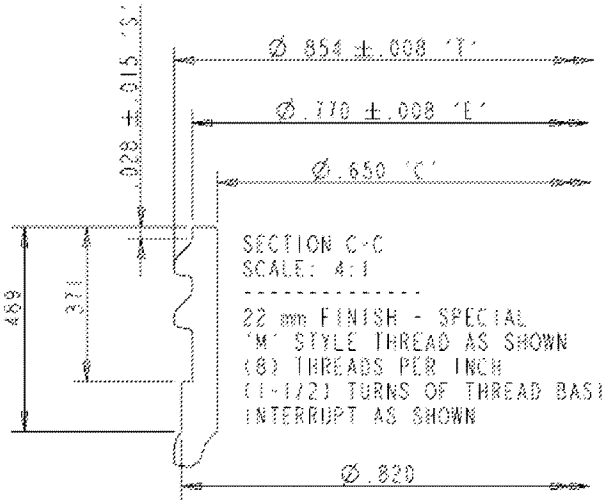
FIG. 13 is a plan view of desired specifications for threads and thread interruptions of the same embodiment of the device from FIG. 11.
Figure 15:
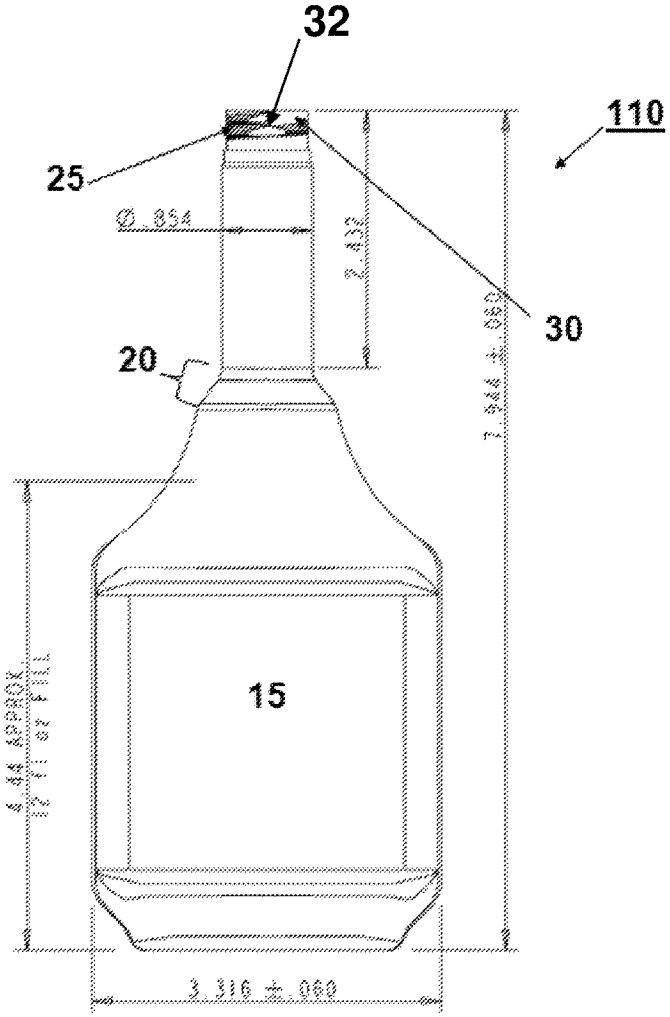
FIG. 15 is a front view of the same embodiment of the device from FIG. 11.
Figure 14:
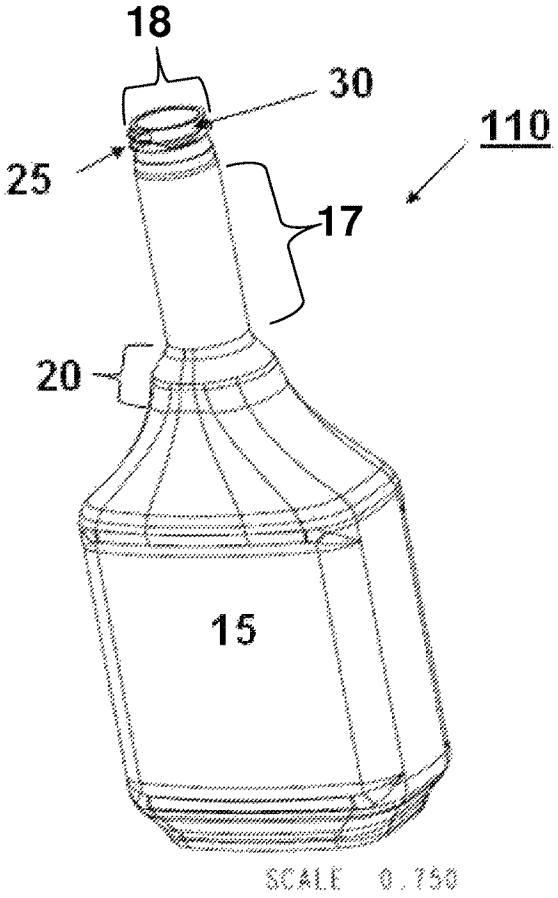
FIG. 14 is a perspective view of the same embodiment of the device from FIG. 11.
Figure 17:
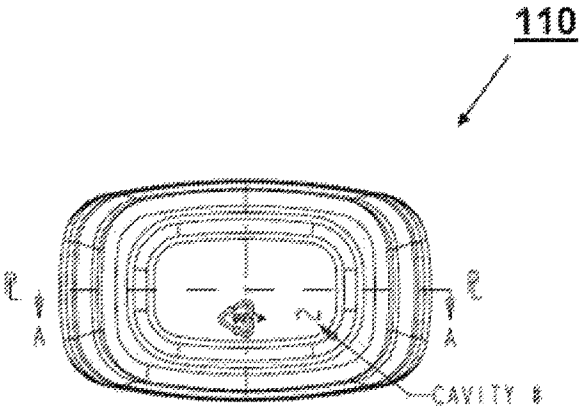
FIG. 17 is a bottom view of the same embodiment of the device from FIG. 11.
Figure 18:
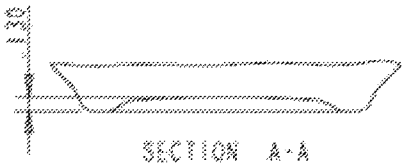
FIG. 18 is a side view of the lower section of the reservoir of the same embodiment of the device from FIG. 11.
Figure 16:
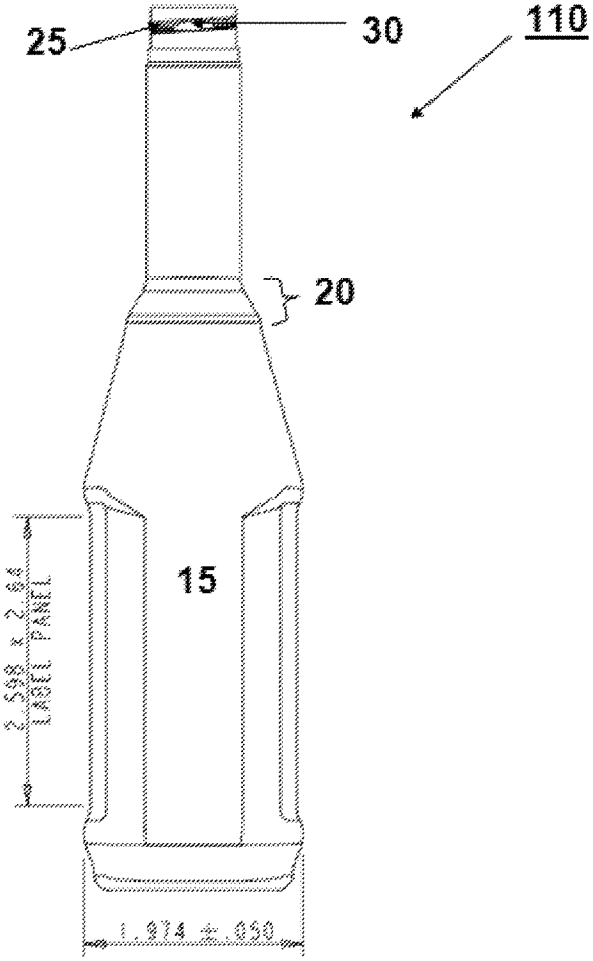
FIG. 16 is a side view of the same embodiment of the device from FIG. 11.
Figure 21:
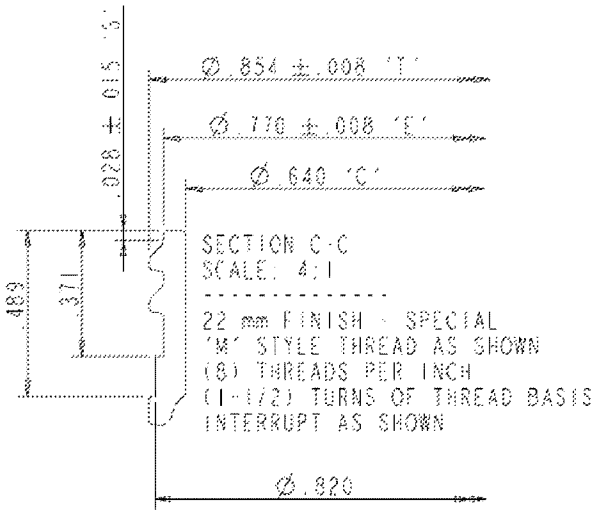
FIG. 21 is a plan view of desired specifications for threads and thread interruptions of the same embodiment of the device from FIG. 19.
Figure 19:
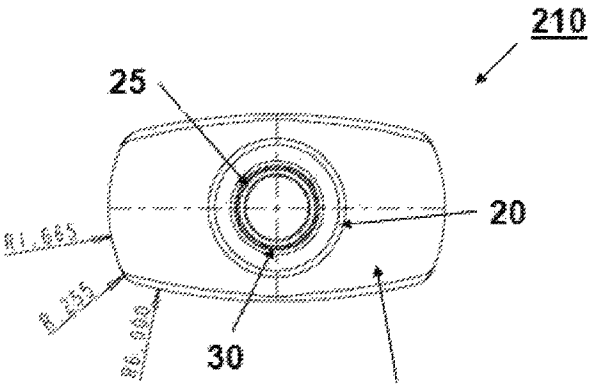
FIG. 19 is a top view of another embodiment of the device.
Figure 20:
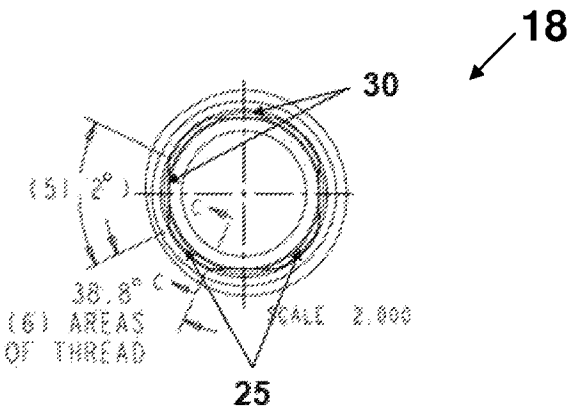
FIG. 20 is another top view of the same embodiment of the device from FIG. 19, depicting the threads and thread interruptions.
Figure 23:
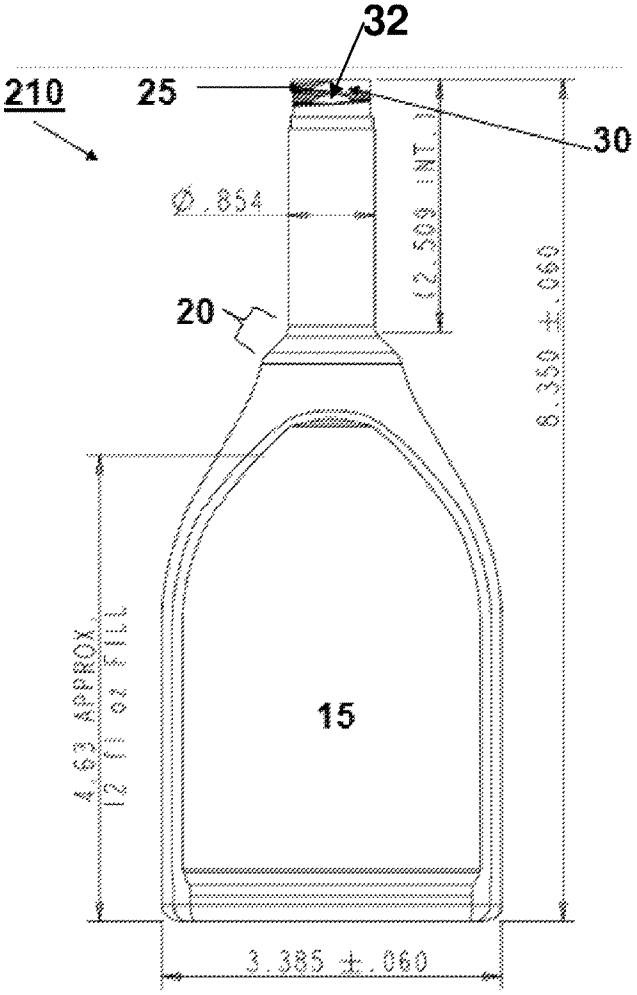
FIG. 23 is a front view of the same embodiment of the device from FIG. 19.
Figure 22:
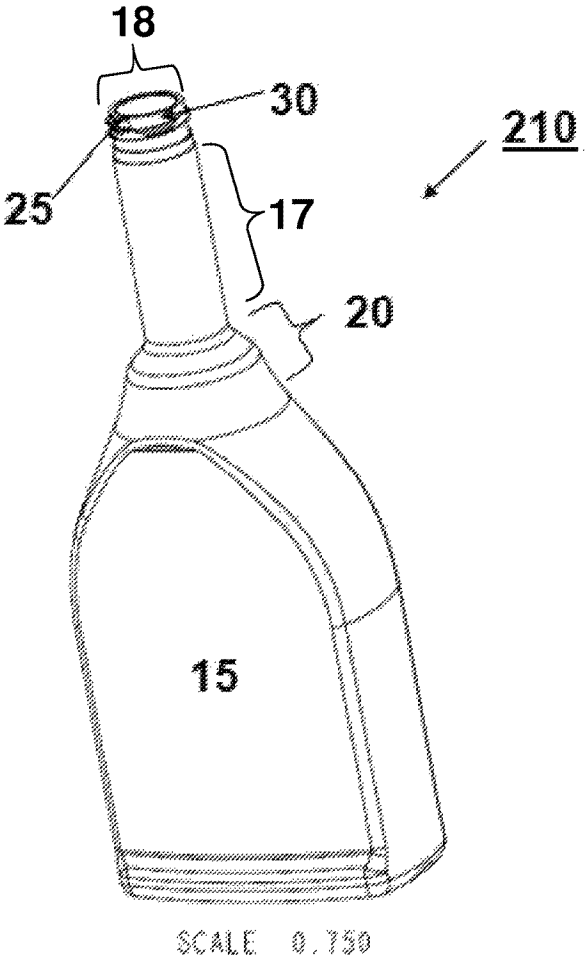
FIG. 22 is a perspective view of the same embodiment of the device from FIG. 19.
Figure 25:
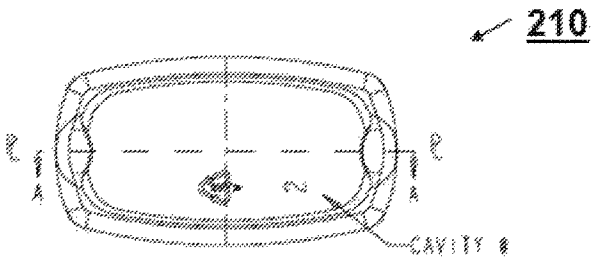
FIG. 25 is a bottom view of the same embodiment of the device from FIG. 19.
Figure 26:
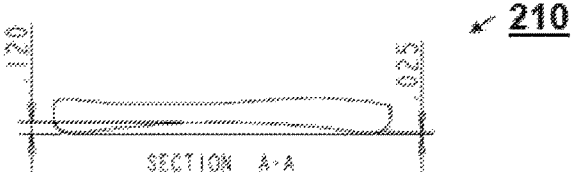
FIG. 26 is a side view of the lower section of the reservoir of the same embodiment of the device from FIG. 19.
Figure 24:
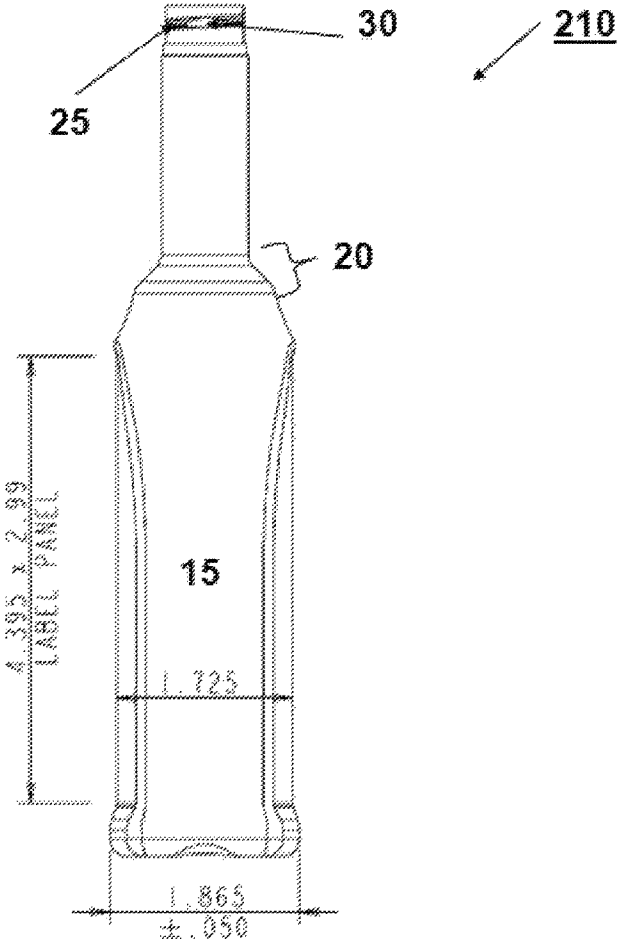
FIG. 24 is a side view of the same embodiment of the device from FIG. 19.
Figure 29:
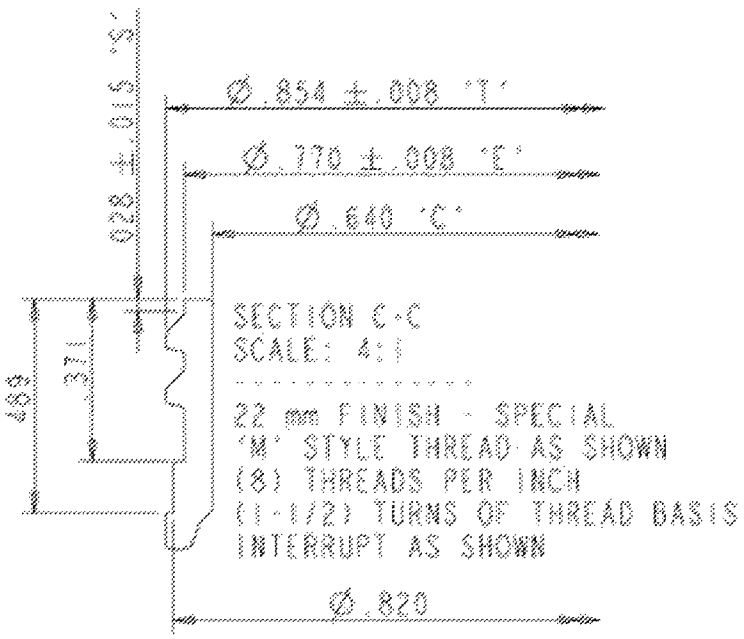
FIG. 29 is a plan view of desired specifications for threads and thread interruptions of the same embodiment of the device from FIG. 27.
Figure 27:
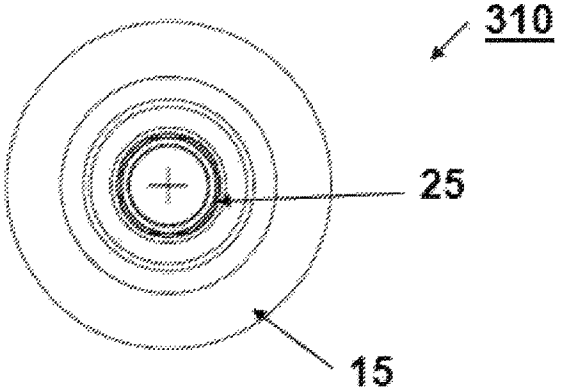
FIG. 27 is a top view of another embodiment of the device.
Figure 28:
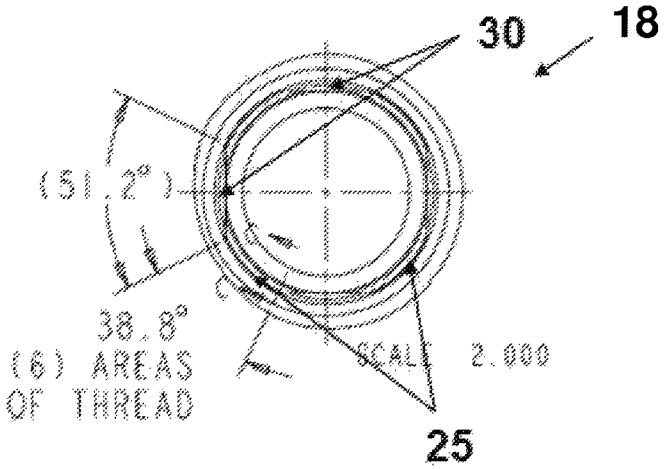
FIG. 28 is another top view of the same embodiment of the device from FIG. 27, depicting the threads and thread interruptions.
Figure 31:
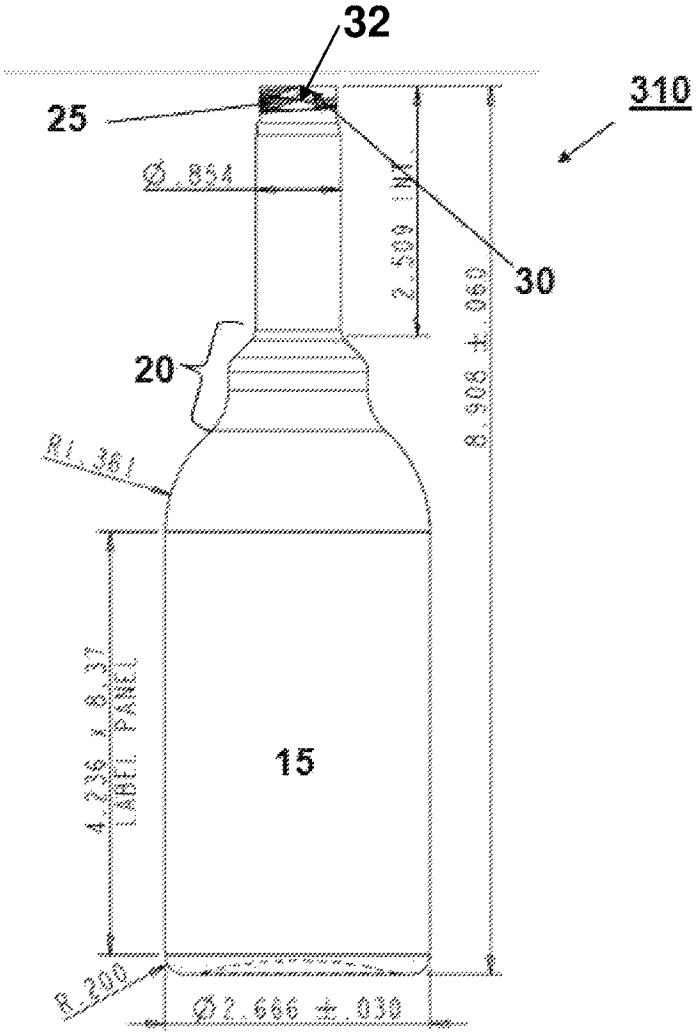
FIG. 31 is a front view of the same embodiment of the device from FIG. 27.
Figure 30:
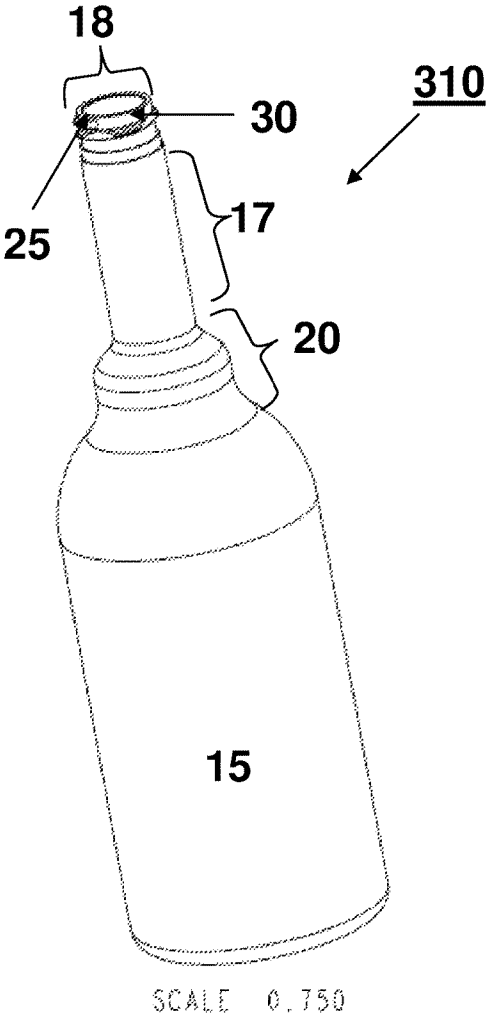
FIG. 30 is a perspective view of the same embodiment of the device from FIG. 27.
Figure 33:
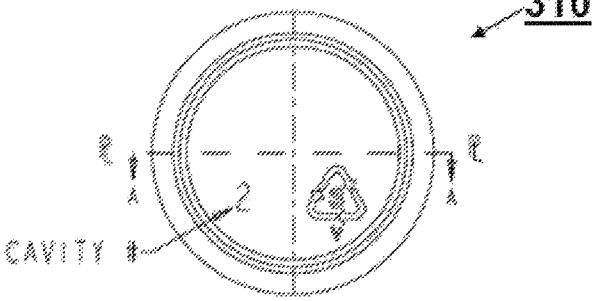
FIG. 33 is a bottom view of the same embodiment of the device from FIG. 27.
Figure 34:
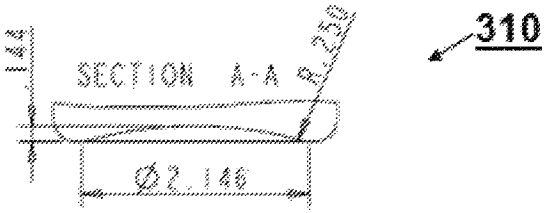
FIG. 34 is a side view of the lower section of the reservoir of the same embodiment of the device from FIG. 27.
Figure 32:
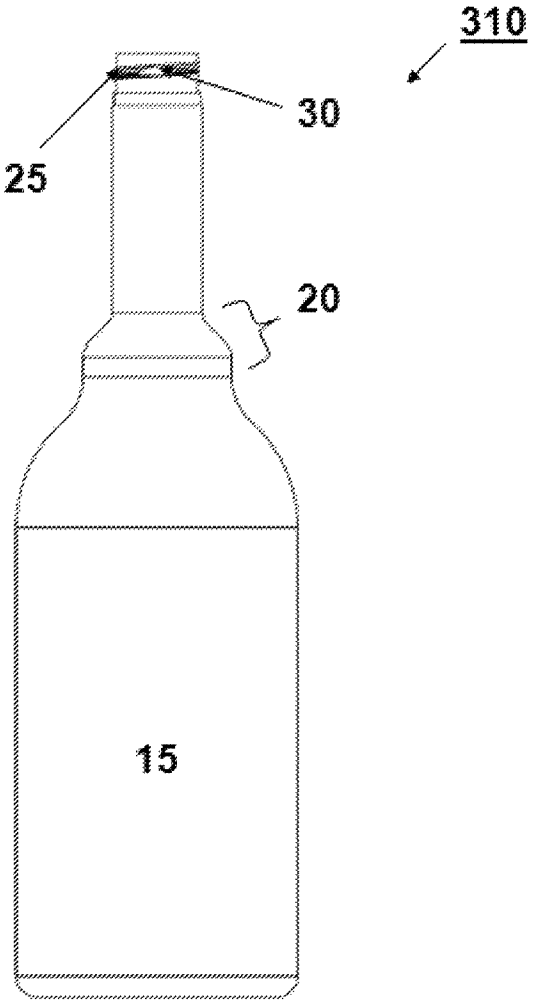
FIG. 32 is a side view of the same embodiment of the device from FIG. 27.
Figure 36:
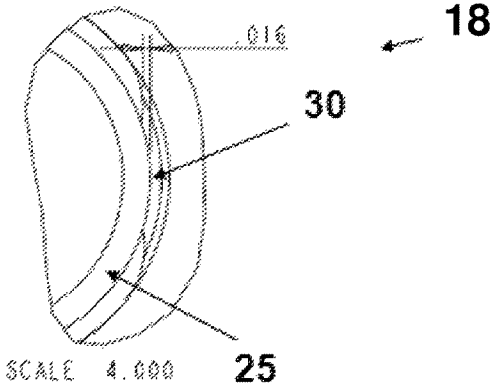
FIG. 36 is close-up top view of the same embodiment of the device from FIG. 35, depicting the threads and thread interruptions.
Figure 35:
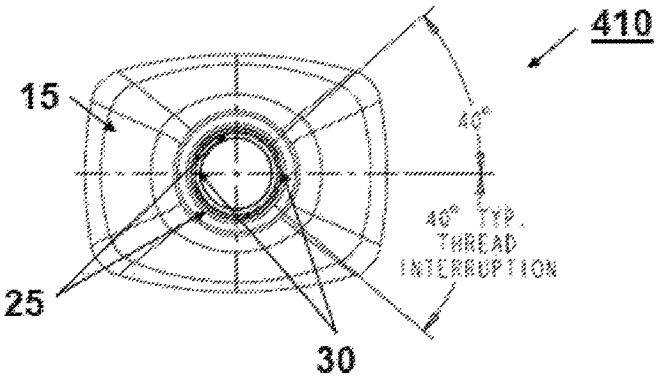
FIG. 35 is a top view of another embodiment of the device.
Figure 37:
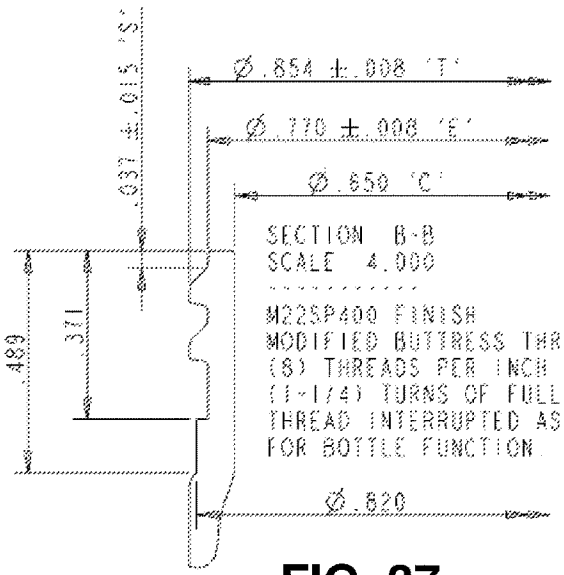
FIG. 37 is a plan view of desired specifications for threads and thread interruptions of the same embodiment of the device from FIG. 35.
Figure 39:
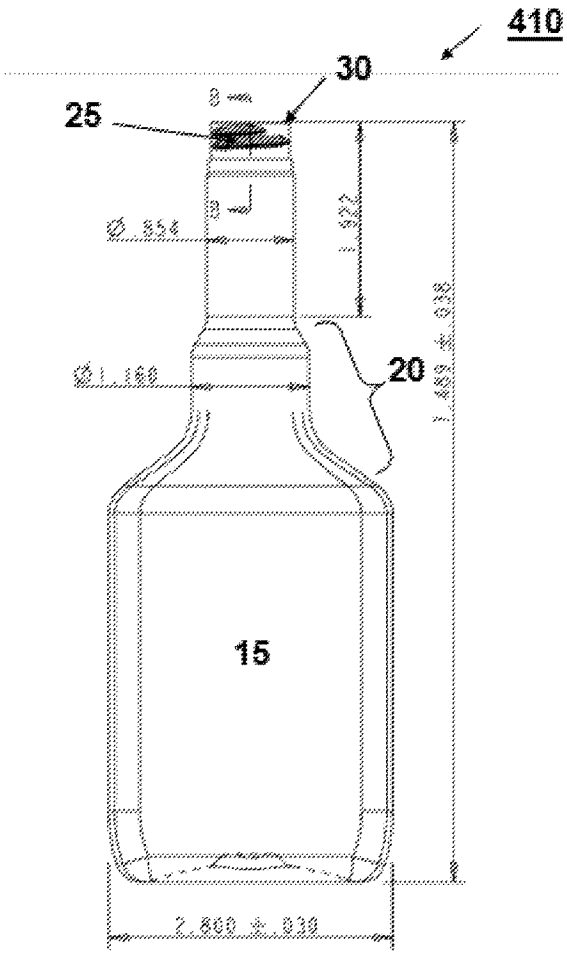
FIG. 39 is a front view of the same embodiment of the device from FIG. 35.
Figure 38:
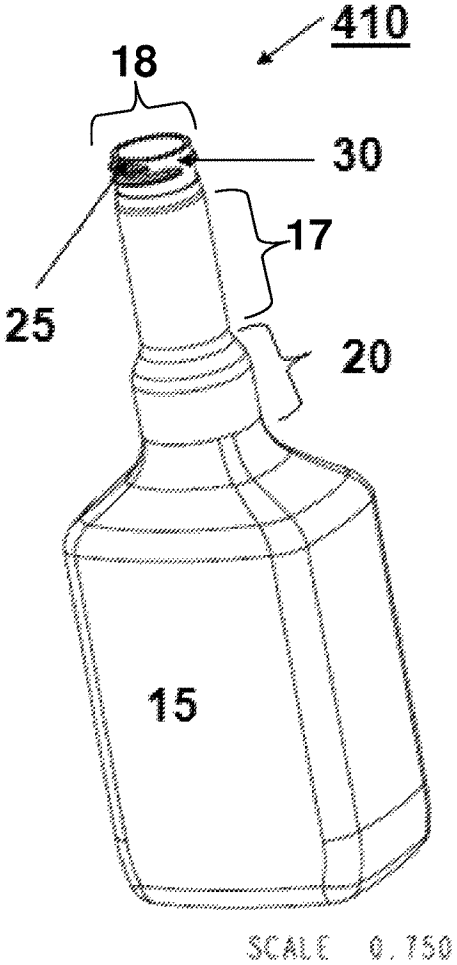
FIG. 38 is a perspective view of the same embodiment of the device from FIG. 35.
Figure 41:
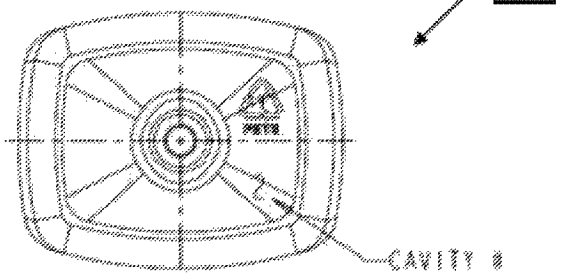
FIG. 41 is a bottom view of the same embodiment of the device from FIG. 35.
Figure 40:
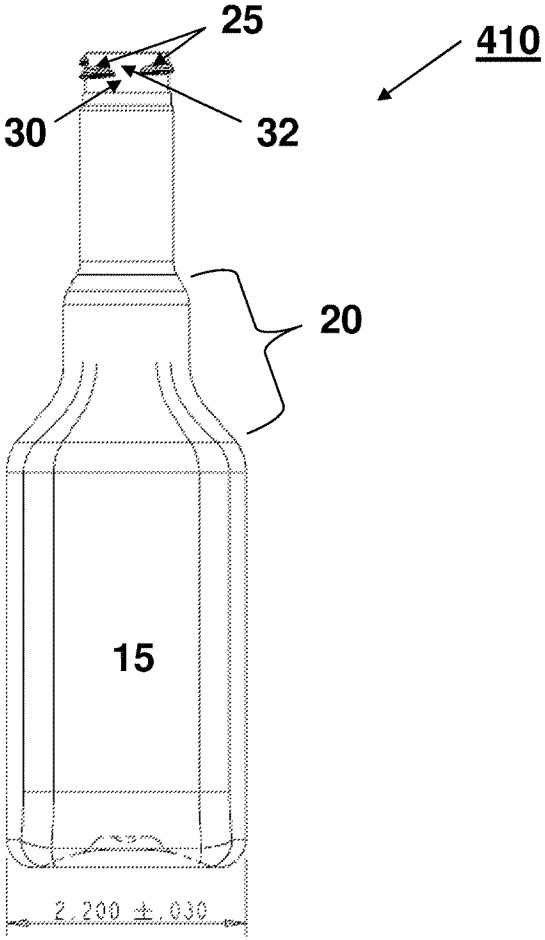
FIG. 40 is a side view of the same embodiment of the device from FIG. 35.

Connected to the distal end of neck 17 is lip 18, also known as the "E" wall, which defines a plurality of threads 25. As shown in representative top view of FIG. 4, threads 25 are not continuous around the perimeter of lip 18, but rather periodically cease, thereby creating thread interruption 30. These thread interruptions 30 are aligned longitudinally with respect to the lip such that threadless path 32 is defined by the lip, as shown in FIG. 7. Examples 1-4 (FIGS. 3-33) depict two threadless paths, while example 5 (FIGS. 34-40) has one threadless path. It is preferred that each threadless path occupies approximately 51° per side of the circumference of the lip. It is desirable that if two threadless paths exist, that they are spaced evenly, i.e. 180°, apart. It is desirable that threads 25 are of a 22 mm, industry standard size, and accept a conventional 22 mm bottle cap.

Bottles 10, 110, 210, 310, 410 and 510 also include transition 20, which connects neck 17 to reservoir 15. Reservoir 15 preferably has a volume of approximately 187 mL to 1000 mL, but volumes between 30 mL to 19 L are within the scope of this invention as well. It is an important feature of this invention that transition 20 and reservoir 15 can be sized and shaped in a variety of ways, as set forth in the various examples, such that companies having specific brand identities may employ the technology of this invention while staying true to their trade dress.

It is desirable that bottles are constructed of a resin, with PVC being a particularly suitable material. It is also desirable that the bottles are constructed by conventional manufacturing methods, such as Extrusion Blow Molding, Injection Blow Molding, Injection Stretch Blow Molding, and the like.

Exemplary examples 1-5 are set forth below.

Example 1, depicted in FIGS. 3-9, preferably has the following manufacturing specifications:

| | |
|---|---|
| SURFACE BELOW FINISH - | xx IN SQ |
| P/L BLOW SURFACE - | xx IN SQ |
| TOLERANCE: .XX ± .010 | ANGLE ± 0° 30' |
| .XXX ± .005 | |
| FINISH: | 22 mm SPECIAL |
| MATERIAL: | PET |

-continued

| | |
|---|---|
| WEIGHT: | 24 ± 1 GRAMS |
| MIN. WALL: | .XXX INCHES |
| NOMINAL CAP'Y: | 355 ± 9 ml (12.0 ± .30 fl oz) |
| OVERFLOW CAP'Y: | 384 ± 9 ml (13.0 ± .30 fl oz) |

Example 2, depicted in FIGS. 10-17 preferably has the following manufacturing specifications:

| | |
|---|---|
| SURFACE BELOW FINISH - | 54.05 IN SQ |
| P/L BLOW SURFACE - | 17.00 IN SQ |
| TOLERANCE: .XX ± .010 | ANGLE ± 0° 30' |
| .XXX ± .005 | |
| FINISH: | 22 mm SPECIAL |
| MATERIAL: | PVC |
| WEIGHT: | 32 ± 1 GRAMS |
| MIN. WALL: | .XXX INCHES |
| NOMINAL CAP'Y: | 355 ± 11 ml (12.0 ± .37 fl oz) |
| OVERFLOW CAP'Y: | 397 ± 11 ml (13.43 ± .37 fl oz) |

Example 3, depicted in FIGS. 18-25 preferably has the following manufacturing specifications:

| | |
|---|---|
| SURFACE BELOW FINISH - | 59.45 IN SQ |
| P/L BLOW SURFACE - | 19.07 IN SQ |
| TOLERANCE: .XX ± .010 | ANGLE ± 0° 30' |
| .XXX ± .005 | |
| FINISH: | 22 mm SPECIAL |
| MATERIAL: | PVC |
| WEIGHT: | 36 ± 3 GRAMS |
| MIN. WALL: | .XXX INCHES |
| NOMINAL CAP'Y: | 355 ± 11 ml (12.0 ± .37 fl oz) |
| OVERFLOW CAP'Y: | 410 ± 11 ml (13.86 ± .37 fl oz) |

Example 4, depicted in FIGS. 26-33 preferably has the following manufacturing specifications:

| | |
|---|---|
| SURFACE BELOW FINISH - | 60.63 IN SQ |
| P/L BLOW SURFACE - | 17.25 IN SQ |
| TOLERANCE: .XX ± .010 | ANGLE ± 0° 30' |
| .XXX ± .005 | |
| FINISH: | 22 mm SPECIAL |
| MATERIAL: | PVC |
| WEIGHT: | 40 ± 2 GRAMS |
| MIN. WALL: | .XXX INCHES |
| NOMINAL CAP'Y: | 473 ± 11 ml (16.0 ± .37 fl oz) |
| OVERFLOW CAP'Y: | 492 ± 11 ml (16.64 ± .37 fl oz) |

Example 5, depicted in FIGS. 34-40, preferably has the following manufacturing specifications:

| | |
|---|---|
| SURFACE BELOW FINISH - | xx IN SQ |
| P/L BLOW SURFACE - | xx IN SQ |
| TOLERANCE: .XX ± .010 | ANGLE ± 0° 30' |
| .XXX ± .005 | |
| FINISH: | M22SP400 |
| MATERIAL: | PET |
| WEIGHT: | 24 ± 1 GRAMS |
| MIN. WALL: | .XXX INCHES |
| NOMINAL CAP'Y: | 355 ± 9 ml (12.0 ± .30 fl oz) |
| OVERFLOW CAP'Y: | 384 ± 9 ml (13.0 ± .30 fl oz) |

In use, one would remove conventional bottle cap 35 (not shown) from bottle 10, and position bottle 10 near fluid receiving aperture 50 of capless fuel system 40, preferably with threadless paths 32 aligned with tabs 45. Bottle 10 may need to be rotated in order to effectuate precise alignment. Once aligned, bottle 10 is pushed towards aperture, thereby depressing tabs 45 with threadless paths 32, until lip 18 is fully inserted into fluid receiving aperture 50. Contents of bottle are then poured into tank by gravity. When desired amount of additive is poured in, bottle is pulled out, cap is optionally replaced, and bottle is stored for later use or properly disposed of.

It should be understood, of course, that the foregoing relates to exemplary embodiments of the invention and that modifications may be made without departing from the spirit and scope of the invention as set forth in the following claims. As used herein, "substantially" shall mean within reasonable limits when considering the limitations of machines and people. By way of example, a "substantially smooth" surface means there are no intentional bumps or irregularities. All ranges inherently include the endpoints themselves, as well as all increments there between, even if not specifically stated. By way of example, " . . . an outside diameter of 0.846 to 0.862 inches . . . " includes 0.846 inches, 0.847 inches, and so forth. Finally, unless otherwise stated, "approximately" and the like shall refer to +/−10%.

What is claimed is:

1. A bottle for use with a capless fuel system having a self-sealing mechanism triggered by tabs, said bottle including:

A) A neck having a circumference, a substantially smooth surface and an outside diameter between 0.846 inches and 0.862 inches;

B) A lip connected to a distal end of said neck, said lip defining a plurality of threads; and C) A plurality of thread interruptions defined by said plurality of threads, said plurality of thread interruptions forming two threadless paths spaced between said threads so as to frame an unobstructed longitudinal axis from said lip to said neck, wherein each threadless path extends 45.9°-56.1° around the circumference of the neck, each threadless path is spaced 162°-198° around the neck from another threadless path, and two threadless paths align with the tabs, and wherein said neck is adapted so when inserting said bottle into said capless fuel system said two threadless paths align with said tabs such that said tabs are depressed along threadless paths and without impeding entry of said neck by said plurality of threads.

2. The bottle of claim 1 wherein said plurality of threads are of an industry standard 22 mm finish.

3. A system for transporting and storing, and for pouring fuel additives into a capless fuel system having a self-sealing mechanism triggered by tabs, said system including:

A) A reservoir with a volume capacity of 30 mL to 19 L;

B) A rigid neck having a circumference in fluid communication with said reservoir;

C) A threaded lip in communication with said rigid neck, said threaded lip including at least two longitudinally-oriented threadless paths, each threadless path spaced 162°-198° around the neck from another threadless path, and each threadless path extending 45.9°-56.1° around the circumference of the rigid neck, and wherein said neck is adapted so when inserting said bottle into said capless fuel system two threadless paths align with two tabs such that said tabs are depressed along threadless paths and without impeding entry of said neck by said plurality of threads; and D) A bottle cap rotatably engaged with said threaded lip.

4. The system of claim 3 wherein said threaded lip includes M style thread.

5. The system of claim 3 wherein said bottle cap is a conventional 22 mm cap.

6. A method of introducing a fluid into a capless fuel system having a self-sealing mechanism triggered by tabs, said method including the steps of:

A) Positioning a threaded lip of a bottle proximal to a fluid receiving aperture of a capless fuel system, said threaded lip having a circumference;

B) Rotating said bottle so two threadless paths of said threaded lip of said bottle align with tabs of said capless fuel system, each threadless path spaced 162°-198° around the neck from another threadless path, and each threadless path extending approximately 45.9°-56.1°around the circumference of the threaded lip;

C) Depressing said tab with said threadless path;

D) Pushing said threaded lip into said fluid receiving aperture such that tabs bypass threads of threaded lip; and E) Depositing contents of said bottle into said aperture by gravity.

7. The method of claim 6 further including the initial step of removing a cap from said lip.

8. The system of claim 3 wherein said reservoir has a volume capacity of 30 mL to 205.7 mL.

9. The system of claim 3 wherein said reservoir has a volume capacity of 205.7 mL to 1100 mL.

10. The system of claim 3 wherein said reservoir has a volume capacity of 1100 mL to 19 L.

* * * * *